United States Patent [19]

Hill

[11] Patent Number: 4,617,906

[45] Date of Patent: Oct. 21, 1986

[54] DWELL CONTROL FOR AN I.C. ENGINE SPARK IGNITION SYSTEM

[75] Inventor: William F. Hill, Stafford, England

[73] Assignee: Lucas Industries, Public Limited Company, Birmingham, England

[21] Appl. No.: 592,439

[22] Filed: Mar. 22, 1984

[30] Foreign Application Priority Data

Apr. 5, 1983 [GB] United Kingdom ..... 8309134

[51] Int. Cl.[4] ..... F02P 3/04

[52] U.S. Cl. ..... 123/617; 123/644

[58] Field of Search ..... 123/599, 602, 617, 609, 123/610, 611, 644

[56] References Cited

U.S. PATENT DOCUMENTS

| | | | |
|---|---|---|---|
| 3,465,739 | 9/1969 | Burson | 123/599 X |
| 3,937,193 | 2/1976 | Kim | 123/611 |
| 4,176,645 | 12/1979 | Jundt et al. | 123/644 |
| 4,253,442 | 3/1981 | Jundt et al. | 123/644 X |
| 4,275,703 | 6/1981 | Bodig et al. | 123/617 |
| 4,403,591 | 9/1983 | Weber | 123/644 X |

*Primary Examiner*—Tony M. Argenbright

[57] ABSTRACT

An internal combustion engine ignition control includes a variable reluctance pick-up with a winding providing signals to an integrator the output of which controls an ignition switching circuit. The ignition switching circuit includes a current limiter circuit which operates to limit the coil current at a maximum level until the instant of ignition. A capacitor is charged and discharged under the control of the current limiter circuit so that the voltage on it depends on the ratio of the time for which the current limiter circuit is in operation to the ignition cycle duration. An active clamping circuit operates to override the integrator under the control of this capacitor so as to apply a variable preconditioning bias to the output of the integrator which has the effect of varying the instant at which the coil current is switched on. Closed loop dwell control is thus provided in a simple and convenient manner.

15 Claims, 5 Drawing Figures

DWELL CONTROL FOR AN I.C. ENGINE SPARK IGNITION SYSTEM

This invention relates to a dwell control for an i.c. engine spark ignition system.

It has already been proposed to control spark ignition using a variable reluctance triggering transducer. The rapid zero crossing transition which occurs in the output of voltage of such a transducer is excellent for triggering ignition. Various attempts have been made, in the past, to use the same transducer for determining when the coil current of a coil type ignition system is caused to commence. Such dwell control was obtained by superimposing a bias voltage on the transducer output waveform and comparing the thus biased waveform with a threshold. Problems were found, however with controlling the dwell period in accordance with engine speed so as to obtain a sufficient coil current on time at high speed whilst obtaining economical operation at low speeds.

It is an object of the present invention to overcome these disadvantages of the prior dwell control arrangements.

According to the invention, there is provided an internal combustion engine spark ignition control comprising a variable reluctance transducer driven by the engine and providing an output having zero transitions coinciding with the desired instants of ignition, an integrating circuit to which the transducer output is connected, means for applying a variable preconditioning bias to the output of said integrating circuit, an ignition coil drive circuit connected to said integrating circuit and operating to commence coil current flow when the integrating circuit goes into a saturated condition at an instant dependent on said variable bias means and to interrupt coil current flow to produce a spark when said integrating circuit comes out of said saturated condition on reversal of the polarity of the transducer output and means sensitive to the ratio of the time in each cycle during which the coil current is adequate to produce a spark to the ignition cycle duration, to control said variable bias means to cause said ratio to take up a desired value.

Preferably, the ignition coil drive circuit includes coil current regulating means which operates in each ignition cycle to limit the coil current to a predetermined level. In this case said ratio sensitive means may be connected so as to be controlled by said current regulating means.

An example of the invention is shown in the accompanying drawings in which.

Figure 1:
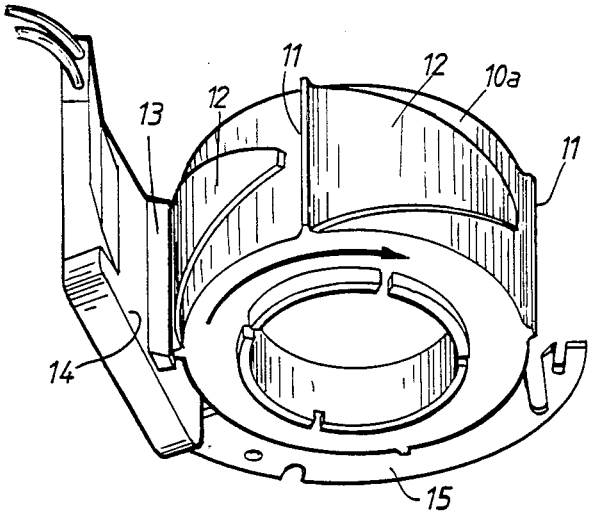
FIG. 1 is a fragmentary perspective view of a variable reluctance transducer intended for use in a control in accordance with the invention.

Referring firstly to FIG. 1, the transducer shown is intended to be incorporated in a conventional ignition distributor incorporating convention speed and vacuum advance mechanisms in place of the contact set normally installed. The transducer includes a drum 10 of ferromagnetic material for mounting on the distributor shaft. This drum 10 has four equally spaced axially extending ribs 11 on its outer curved surface 10*a* and also four triangular raised surface portions 12 on the surface 10*a* between the ribs. The drum 10 coacts with a pick-up having an elongated pole piece 13 and an encapsulated winding 14 surrounding the pole piece. The pick-up is mounted on a bracket 15 which, in use, is mounted on the timing plate of the distributor, i.e. the part which is turned about the distributor axis by the vacuum advance mechanism. A magnetic circuit is formed by the drum 10, the pole piece 13, the bracket 15, the timing plate and the shaft, a magnet, not shown, being included in this circuit as is usual in variable reluctance transducers.

With a transducer as described above, the output of the winding 14 depends on the rate of change of the flux in the magnetic circuit. Thus, as the triangular portion 12 is passing the pole piece, the flux is increasing linearly and a relatively low level constant voltage is output. As a rib reaches the pole piece the voltage rises suddenly to a positive peak and then falls very quickly to a negative peak, whereafter the waveform repeats. The voltage levels are substantially directly proportional to engine speed.

Figure 2:
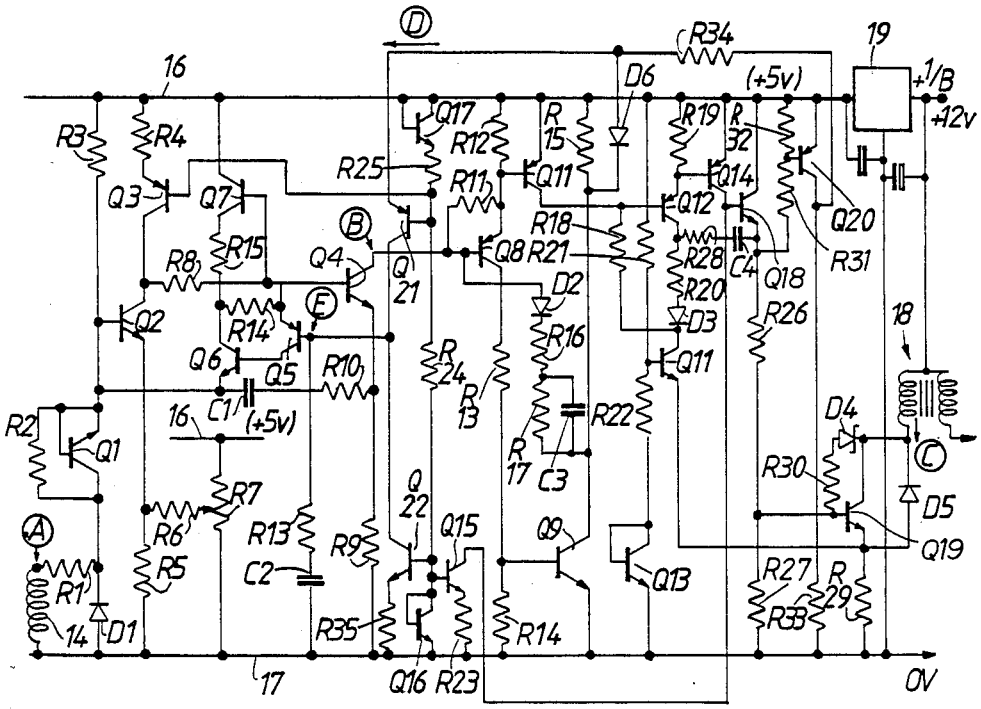
FIG. 2 is the circuit diagram of the control.

As shown in FIG. 2, the circuit of the control includes a resistor $R_1$ and a diode $D_1$ connected in series across the winding 14, one end of the winding and the anode of the diode being grounded and the coil being arranged so that the diode $D_1$ conducts during the aforementioned negative peaks of the output waveform. A diode connected npn transistor $Q_1$ has its collector connected to the cathode of diode $D_1$ and its base and emitter connected to the base of a npn transistor $Q_2$ which forms the input of an active integrating circuit.

A resistor $R_2$ connects the cathode of diode $D_1$ to the base of transistor $Q_2$ which is also connected by a resistor $R_3$ to a +5 V rail 16. The collector of transistor $Q_2$ is connected to the collector of a pnp transistor $Q_3$ which has its emitter connected by a resistor $R_4$ to the rail 16. Transistor $Q_3$ acts as a constant current collector load for transistor $Q_2$. The emitter of transistor $Q_2$ is connected to a ground rail 17 by a resistor $R_5$ and is also connected by a resistor $R_6$ to the slider of a potentiometer $R_7$ connected between the rail 16 and the ground rail 17. The collector of transistor $Q_2$ is connected by a resistor $R_8$ to the base of a npn transistor $Q_4$ which provides the output of the integrating circuit. A resistor $R_9$ connects the emitter of transistor $Q_3$ to the rail 17 and a feedback path, comprising a capacitor $C_1$ and a resistor $R_{10}$ in series, connects the emitter of transistor $Q_4$ to the base of transistor $Q_2$. The collector of transistor $Q_4$ is connected by two resistors $R_{11}$, $R_{12}$ in series to the rail 16.

When the output voltage of the winding is positive, the integrating circuit acts as a normal active integrator. The transistor $Q_1$ is non-conductive so that the time constant of the integrator is determined by resistor $R_2$ and capacitor $C_1$. Thus the relatively low constant voltage portion of the output waveform of the winding 14 causes the voltage at the emitter of transistor $Q_4$ to ramp downwardly at a constant rate so as to maintain a "virtual earth" at the base of transistor $Q_2$. The positive peak of the output waveform would cause the emitter voltage of transistor $Q_4$ to fall more rapidly briefly if the transistor $Q_4$ were not already turned off, i.e. if the integrating circuit were not already saturated. The circuit values are, however, chosen to ensure that the integrating circuit does saturate and the transistor $Q_4$ does turn off in each cycle. When the output of the winding swings negatively, the transistor $Q_4$ turns on very rapidly. Transistor $Q_1$ becomes conductive so that the input impedance of the integrating circuit becomes very low and its time constant becomes very short.

A circuit is provided for limiting the voltage to which the base of transistor $Q_4$ can rise when it turns on as mentioned above. This circuit comprises a pnp transistor $Q_5$ having its base connected by a resistor $R_{13}$ to one side of a capacitor $C_2$ the other side of which is grounded to rail 17. The emitter of the transistor $Q_5$ is connected to the base of the transistor $Q_4$ and its collector is connected to the base of an npn transistor $Q_6$ which has its emitter connected to the base of the transistor $Q_2$. The collector of the transistor $Q_6$ is connected by a resistor $R_{14}$ to the emitter of transistor $Q_5$ and by a resistor $R_{15}$ to the emitter of an npn transistor $Q_7$. The collector of transistor $Q_7$ is connected to the +5 V rail 16 and its base is connected to the base of the transistor $Q_4$. This circuit acts to clamp the base of the transistor $Q_4$ at a maximum voltage one diode drop above the voltage on capacitor $C_2$, and does this in a manner such that the clamping circuit turns on progressively and avoids unwanted parasitic oscillations.

The collector of the transistor $Q_4$ is connected to the base of a pnp transistor $Q_8$ which has its emitter/base in series with the resistor $R_{11}$ and its collector connected by two resistors $R_{13}$, $R_{14}$ in series to the rail 17. An npn transistor $Q_9$ has its base connected to the junction of the resistors $R_{13}$, $R_{14}$ and its emitter connected to rail 17. A resistor $R_{15}$ connects the collector of the transistor $Q_9$ to the rail 16. A capacitor $C_3$ and a resistor $R_{16}$ in series connect the collector of the transistor $Q_9$ to the cathode of a diode $D_2$ having its anode connected to the base of the transistor $Q_8$. A resistor $R_{17}$ is connected in parallel with the capacitor $C_3$, but has a high ohms value compared with resistor $R_{16}$. Transistors $Q_8$ and $Q_9$ operate as a regenerative switch, both transistors turning on when transistor $Q_4$ turns on and turning off when transistor $Q_4$ turns off. The transient positive feedback provided by capacitor $C_3$ and resistor $R_{16}$ ensures that once the switch $Q_8$, $Q_9$ turns on, it remains on for a minimum period irrespective of what happens to transistor $Q_4$, the values of the components being chosen to make this period about 0.3 mS. This arrangement provides in known manner immunity from interference caused by the ignition spark.

The emitter of the transistor $Q_8$ is connected to the base of a pnp transistor $Q_{10}$ which has its emitter connected to rail 16 and its collector connected to the collector of an npn transistor $Q_{11}$ by a resistor $R_{18}$. The collector of the transistor $Q_{10}$ is also connected to the base of a pnp transistor $Q_{12}$ which has its emitter connected by a resistor $R_{19}$ to the rail 16. The collector of transistor $Q_{12}$ is connected by a resistor $R_{20}$ to the anode of a diode $D_3$ the cathode of which is connected to the collector of transistor $Q_{11}$. The base of transistor $Q_{11}$ is connected by a resistor $R_{21}$ to the rail 16 and by a resistor $R_{22}$ to the collector and base of an npn transistor $Q_{13}$ which has its emitter connected to the rail 17.

The emitter of transistor $Q_{12}$ is also connected to the base of a pnp transistor $Q_{14}$ which has its emitter connected to the rail 16 and its collector connected to the collector of an npn transistor $Q_{15}$ which has its emitter connected by a resistor $R_{23}$ to the rail 17. The base of the transistor $Q_{15}$ is connected to the base and collector of an npn transistor $Q_{16}$ the emitter of which is connected to the rail 17, the collector and base of transistor $Q_{16}$ being connected by two resistors $R_{24}$, and $R_{25}$ in series to the emitter of an npn transistor $Q_{17}$ having its base and collector connected to the rail 16. The transistor $Q_{16}$ biases the transistor $Q_{15}$ to operate as a constant current sink and transistor $Q_{17}$ provides bias for transistor $Q_3$, which has its base connected to the junction of resistors $R_{24}$, $R_{25}$.

The collector of the transistor $Q_{14}$ is connected to the base of an npn transistor $Q_{18}$ which has its collector connected to the rail 16 and its emitter connected by two resistors $R_{26}$, $R_{27}$ in series to the rail 17 and by a capacitor $C_4$ and a resistor $R_{28}$ in series to the collector of the transistor $Q_{12}$. An npn Darlington output transistor $Q_{19}$ has its base connected to the junction of resistors $R_{26}$ and $R_{27}$, its emitter connected by a current sensing resistor $R_{29}$ to ground and its collecter connected via the primary winding of ignition coil 18 to a 12 V supply (a vehicle battery) to which the rail 16 is also connected by a voltage regulator circuit 19. The emitter of the transistor $Q_{19}$ is connected to the emitter of transistor $Q_{11}$. To protect the transistor $Q_{19}$ against transient over voltages caused by its inductive load, a zener diode $D_4$ and a resistor $R_{30}$ are connected in series between the collector and base of transistor $Q_{19}$. Furthermore a diode $D_5$ has its anode connected to the emitter of transistor $Q_{19}$ and its cathode connected to the collector thereof to protect the transistor $Q_{19}$ against reverse voltages.

Transistor $Q_{11}$ operates to provide an ignition coil current regulation function. The voltage at its base is fixed by the resistors $R_{21}$, $R_{22}$ (transistor $Q_{13}$ providing temperature compensation for the base emitter junction of transistor $Q_{11}$). When the transistors $Q_8$ and $Q_9$ turn off, transistor $Q_{10}$ turns off and transistors $Q_{12}$, $Q_{14}$, $Q_{18}$ and $Q_{19}$ turn on so that current flow in the primary winding starts to build up. At this stage the transistor $Q_{11}$ is hard on because the voltage across $R_{29}$ is low. As coil current grows, the emitter voltage of transistor $Q_{11}$ starts to rise until the point is reached where the current passed by transistor $Q_{11}$ starts to fall, thereby reducing the current in transistor $Q_{14}$ until, when the primary current reaches a predetermined level, an equilibrium condition is established. The stability of the equilibrium is assured by the resistor $R_{28}$ and the capacitor $C_4$ which reduce the gain of the current control loop at high frequencies, thereby preventing excitation of the coil resonances. Diode $D_3$ is included to prevent any possibility of base current in transistor $Q_{19}$ being sustained briefly by charging of capacitor $C_4$ when transistor $Q_{12}$ turns off.

The voltage on capacitor $C_2$ is determined by the fraction of the cycle time for which the coil current is at its regulated level. To this end a pnp transistor $Q_{20}$ has its base connected to the junction of two resistors $R_{31}$, $R_{32}$ connected in series with one another across the transistor $Q_{18}$ and its emitter connected to the rail 16. The collector of transistor $Q_{20}$ is connected by a resistor $R_{33}$ to the rail 17 and by a resistor $R_{34}$ to the emitter of a pnp transistor $Q_{21}$ which has its base connected to the junction of the resistors $R_{24}$ and $R_{25}$. The collector of the transistor $Q_{21}$ is connected in turn to the collector of an npn transistor $Q_{22}$ which has its base connected to the collector of transistor $Q_{16}$ and its emitter connected by a resistor $R_{35}$ to rail 17. The collectors of transistors $Q_{21}$, $Q_{22}$ are connected to the base of transistor $Q_5$ and the transistors $Q_{21}$ and $Q_{22}$ provide a constant current sink and a switchable constant current source for respectively dis-charging and charging the capacitor $C_2$. The values are chosen so that transistor $Q_{22}$ sinks about one tenth of the current which transistor $Q_{21}$ passes when conducting. A diode $D_6$ connects the emitter of transistor $Q_{21}$ to the collector of transistor $Q_9$, so that no current is passed by transistor $Q_{21}$ except when transistor $Q_{20}$ is on whilst transistor $Q_9$ is off. This occurs only when current limit operation is taking place, it being appreciated that transistor $Q_{20}$ always turns on when transistor $Q_9$ is on.

When the closed loop dwell control is in equilibrium, the current limit operation will be taking place for one tenth of the ignition cycle time. The amount of charge received by the capacitor $C_2$ in each cycle will then be equal to the total amount lost via the transistor $Q_{22}$ and the voltage on capacitor $C_2$ will remain substantially constant. The capacitance of capacitor $C_2$ is such, in relation to the charge and discharge currents, that only a small fractional change in the voltage on capacitor $C_2$ can occur in any cycle at engine running speeds. Should the fractional on time of the transistor $Q_{20}$ fall below one-tenth, the capacitor $C_2$ voltage will fall slowly and hence the voltage to which the integrator is reset will fall. Thus the transistor $Q_4$ will turn off earlier in the integrating period to restore the fractional on time to one tenth. Similarly, the voltage on capacitor $C_2$ rises and reduces the fractional on time should the latter become higher than one tenth.

Each time transistors $Q_8$ and $Q_9$ turn on the output transistor $Q_{19}$ turns off and a spark is generated in the usual way.

Figure 3:
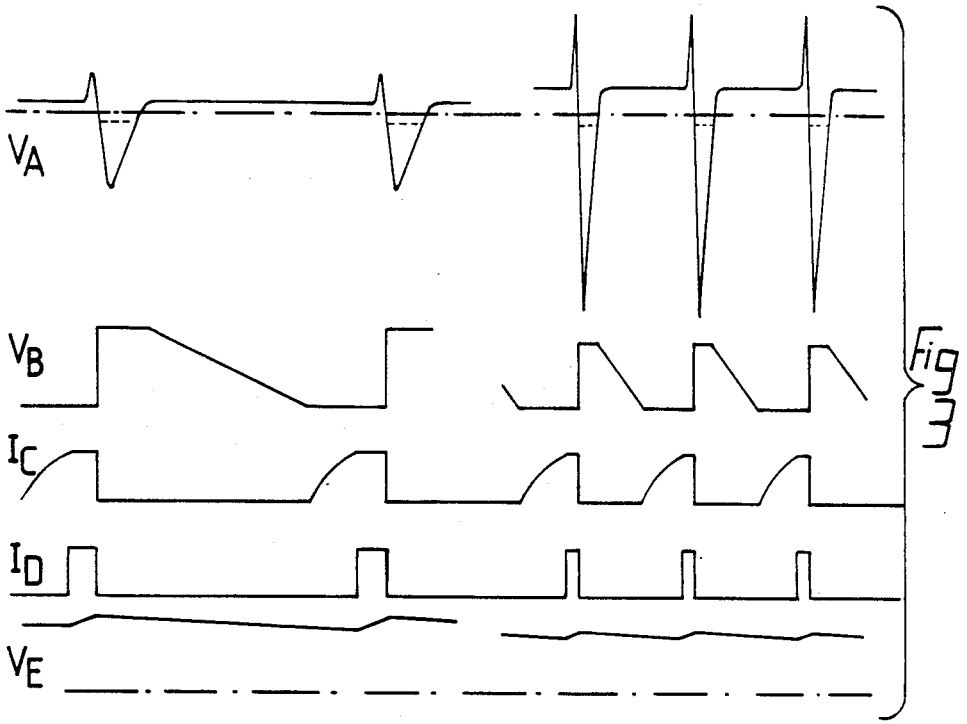
FIG. 3 is a set of graphs showing voltage waveforms at points A, B and E in FIG. 2 and current waveforms at points C and D therein at two different engine speeds.

FIG. 3 shows voltage and current waveforms at the marked points in FIG. 2 and illustrates equilibrium conditions at two different steady speeds.

Figure 4:
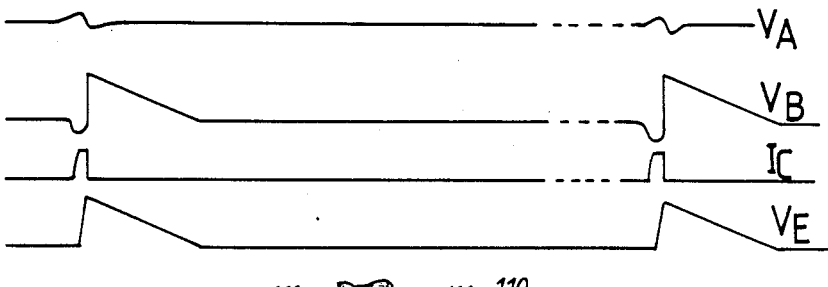
FIG. 4 is a set of graphs showing waveforms at points A, B, C and E at a very low engine speed and on a different scale from FIG. 3.

FIG. 4 shows what occurs at a very low speed. It will be noted that the level of signal from the transducer as the triangular portion 12 is passing the pick-up is insignificant at such a speed. The integrator output being pulled down in each cyle by the capacitor $C_2$ discharging, until transistor $Q_2$ saturates at which point transistor $Q_4$ still conducts sufficiently to prevent the coil conducting.

The purpose of the resistor $R_{13}$ in series with the capacitor $C_2$ is to prevent the capacitor from being charged up by interference spikes.

Although the transducer shown in FIG. 1 utilises the triangular portions 12 to provide linearly increasing flux, the same effect could be obtained in many other ways. For example, the parts of the drum 10 between the ribs 11 could be shaped to cause the radial gap to decrease at an appropriate rate, it being borne in mind that the flux varies inversely with the gap. The ribs 11 provide an increase in flux just before the spark is required, sufficient to ensure that coil current is always switched on in every cycle, even at cranking speed.

In the above embodiment, the resistor $R_{10}$ in series with the capacitor $C_1$ hereby compensates for transducer eddy current lag at high speeds and has no significant effect on the integrator output during the integration period. If desired a higher value resistor $R_{10}$ may be employed and the integrator waveform then includes a downward step at the instant when the transducer output becomes positive and at very high speeds this step can be large enough to commence the coil current flow.

In the alternative form of transducer shown in FIG. 5, the unit is again intended to be incorporated in a conventional speed and vacuum advance ignition distributor. Instead of the drum 10 of FIG. 1 the unit of FIG. 5 utilises a cup-shaped member 110 on the distributor shaft. The cylindrical surface of member 110 is cut away to provide four tapering portions 112 corresponding to the portions 12 of FIG. 1. Ribs 111 are provided on this surface at the wider ends of the tapering portions 112. The surface of the member 110 is notched between these ribs and the narrower ends of the tapering portions 112.

Figure 5:
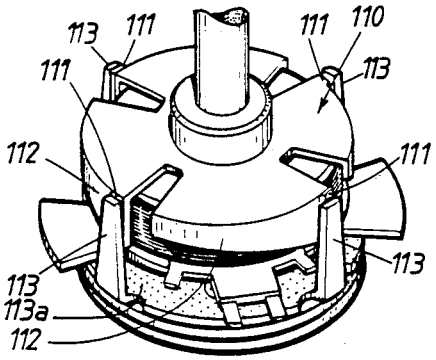
FIG. 5 is a fragmentary perspective view of another form of variable reluctance transducer.

The "stator" of the unit of FIG. 5 includes a magnetic disc 113*a* on which four equally spaced axially extending fingers 113 forming pole pieces are provided and these fingers lie outside the member 110. This disc 113*a* is connected to the vacuum advance mechanism. A winding 114 is incorporated in the unit within the member 110, the magnetic circuit of the transducer comprising the disc 113*a*, the fingers 113, the cylindrical surface of the member 110, the end surface of member 110 and the shaft. It will be noted that all four pole fingers 113 form parallel paths in the magnetic circuit and these will be adjacent the ribs 111 simultaneously as the shaft rotates.

The construction shown in FIG. 5 is extremely compact and can provide a better electrical output than a unit as shown in FIG. 1 of the same size.

Resistor $R_{19}$ may, if desired, be replaced by a constant current source transistor (pnp) controlled by the voltage across $Q_{17}$, i.e. similar to the arrangement $Q_{16}/Q_{22}$, in order to improve the temperature stability of the current limit value.

I claim:

1. An internal combustion engine spark ignition control comprising a variable reluctance transducer driven by the engine and providing an output having zero transitions coinciding with the desired instants of ignition, an integrating circuit to which the transducer output is connected, means for applying a variable preconditioning bias to the output of said integrating circuit, an ignition coil drive circuit connected to said integrating circuit and operating to commence coil current flow when and because the integrating circuit goes into a saturated condition at an instant dependent on said variable bias means and to interrupt coil current flow to produce a spark when said integrating circuit comes out of said saturated condition on reversal of the polarity of the transducer output and means sensitive to the time fraction in each cycle during which the coil current is adequate to produce a spark to the ignition cycle duration, to control said variable bias means to cause said fraction to take up a desired value.

2. A control as claimed in claim 1 in which said ignition coil drive circuit comprises coil current regulating means operating in each ignition cycle to limit the coil current to a predetermined level.

3. A control as claimed in claim 2 in which said fraction sensitive means is connected to said coil current regulating means for control thereby.

4. A control as claimed in claim 3 in which said fraction sensitive means comprises a signal storage device, charge and discharge path means associated with said signal storage device and incorporating switch means connected to said coil current regulating means for control thereby, whereby when the ratio of the time in each cycle during which said coil current regulating means is in operation to the ignition cycle duration is at a desired value, the average signal stored in said signal storage device remains substantially constant.

5. A control as claimed in claim 1 in which said integrating circuit includes an input stage having an input terminal connected by a resistor to said transducer output, an output stage coupled to said input stage, and a capacitor connected between an output terminal of the output stage and the input terminal of the input stage; said variable bias means comprising an active clamp circuit connected to provide feedback around the input stage under the control of said ratio sensitive means.

6. A control as claimed in claim 1 in which said integrating circuit comprises an input transistor having its base connected by a first resistor to said winding, its emitter connected to a point which is held at a substantially fixed potential and its collector connected to a supply via load means, an output transistor, a second resistor connecting the collector of said input transistor to the base of said output transistor, said output transistor having its collector and emitter connected across the supply via respective collector load means and emitter load means, and a capacitor connecting the emitter of the output transistor to the base of the input transistor, said variable bias means comprising an active clamping circuit connected to said ratio sensitive means and operating to clamp the base of said output transistor at a maximum value determined by said ratio sensitive means.

7. A control as claimed in claim 6 in which said active clamp circuit comprises a first transistor having its base connected to said ratio sensitive circuit and its emitter connected to the base of said output transistor and a second transistor having its base connected to the collector of said first transistor, its emitter connected to the base of the input transistor and its collector connected to current source means.

8. A control as claimed in claim 7 in which said current source means comprises a third transistor having its base connected to the base of the output transistor, its emitter connected by resistor means to the collector of the second transistor and its collector connected to said supply, further resistor means connecting the collector of the second transistor to the base of said output transistor.

9. A control as claimed in claim 8 in which said ratio sensitive means includes a signal storage capacitor connecting the base of said first transistor to ground, and charge and discharge path means for said capacitor connected to be controlled by said ignition coil drive circuit so as to store on said capacitor a voltage representing said ratio.

10. A control as claimed in claim 1 in which the transducer includes a rotor, a stator having at least one pole piece, said rotor and stator forming part of a magnetic circuit, the reluctance of which varies with the position of the rotor relative to the stator and a winding linked with said circuit, the rotor having a plurality of tapering portions arranged to pass said pole piece as the rotor turns and thereby provide continuously changing reluctance in said magnetic circuit over a significant angle of rotation of said rotor.

11. A control as claimed in claim 10 in which said rotor is a drum having a generally cylindrical curved surface, said tapering portions being defined by triangularly shaped raised areas of said curved surface.

12. A control as claimed in claim 11 in which the rotor also has ribs on said curved extending axially thereof and disposed at the wider ends of said triangularly shaped areas.

13. A control as claimed in claim 10 in which the rotor is in the form of a cup-shaped member having a cylindrical curved surface and an end surface, said curved surface being cut away to form said tapering portions.

14. A control as claimed in claim 4 in which the said discharge path means operates continuously.

15. A control as claimed in claim 4 in which the discharge of the said storage device is effectively limited at a level too high to sustain or initiate coil current when the transducer output is held at zero.

* * * * *